US009854353B2

(12) United States Patent
Wang

(10) Patent No.: US 9,854,353 B2
(45) Date of Patent: Dec. 26, 2017

(54) OMNI-DIRECTIONAL PORTED SPEAKER

(71) Applicant: Tymphany Hong Kong Ltd, Wanchai (HK)

(72) Inventor: Kaili Wang, Taoyuan (TW)

(73) Assignee: TYMPHANY HONG KONG LTD., Wanchai (HK)

( * ) Notice: Subject to any disclaimer, the term of this patent is extended or adjusted under 35 U.S.C. 154(b) by 108 days.

(21) Appl. No.: 14/872,451

(22) Filed: Oct. 1, 2015

(65) Prior Publication Data

US 2016/0353199 A1 Dec. 1, 2016

(30) Foreign Application Priority Data

May 28, 2015 (CN) ..... 2015 1 0284222

(51) Int. Cl.
*H04R 1/20* (2006.01)
*H04R 1/34* (2006.01)

(52) U.S. Cl.
CPC ..... *H04R 1/345* (2013.01)

(58) Field of Classification Search
CPC .... H04R 1/345; H04R 1/2842; H04R 1/2865; H04R 2201/029
See application file for complete search history.

(56) References Cited

U.S. PATENT DOCUMENTS 3,097,720 A * 7/1963 Taylor, Jr. ..... H04R 1/30 181/152
3,327,808 A * 6/1967 Shaper ..... H04R 1/2857 181/153
3,371,742 A * 3/1968 Norton ..... H04R 1/345 181/153
4,196,792 A * 4/1980 Grieves ..... H04R 1/2826 181/156
4,298,087 A * 11/1981 Launay ..... H04R 1/345 181/153
4,348,549 A * 9/1982 Berlant ..... H04R 1/26 181/152
(Continued)

FOREIGN PATENT DOCUMENTS

DE 202012000148 U1 * 3/2012 ..... H04R 1/26
GB 2184323 A * 6/1987 ..... H04R 1/2826

*Primary Examiner* — Ryan Robinson
(74) *Attorney, Agent, or Firm* — Cantor Colburn LLP

(57) ABSTRACT

An omni-directional ported speaker including a cabinet which has a space, a first opening, and a second opening, and a first cover member connected to the cabinet, where the space of the cabinet is for disposing a driver that includes a diaphragm portion disposed within and closing the second opening of the cabinet, where the first cover member has a first duct and a plurality of second ducts, and the first duct and each of the second ducts has two openings, one of the two openings of the first duct is coupled to one of the openings of the second ducts, and the other opening of the first duct is disposed proximate to the driving portion of the driver and the first duct is arranged along the direction from the first opening toward the second opening of the cabinet, and the other openings of the second ducts are arranged in the cover member, where the first duct and the second ducts delimit a first angle, and each of the second ducts delimit a second angle between adjacent second ducts.

15 Claims, 3 Drawing Sheets

(56) References Cited

U.S. PATENT DOCUMENTS

| | | | | | |
|---|---|---|---|---|---|
| 4,496,021 | A * | 1/1985 | Berlant | G10K 11/025 | 181/152 |
| 5,446,792 | A * | 8/1995 | Sango | H04R 1/345 | 181/155 |
| 5,721,401 | A * | 2/1998 | Sim | H04R 1/345 | 181/148 |
| 6,578,660 | B2 * | 6/2003 | Taylor | H04R 1/345 | 181/154 |
| 6,719,091 | B1 * | 4/2004 | Brown | H04R 1/345 | 181/153 |
| 6,973,994 | B2 * | 12/2005 | Mackin | H04R 1/00 | 181/145 |
| 7,162,049 | B2 * | 1/2007 | Polk, Jr. | H04R 1/2826 | 181/156 |
| 7,450,733 | B2 * | 11/2008 | Suprapmo | H04R 1/2826 | 381/337 |
| 7,520,368 | B2 * | 4/2009 | Moore | H04R 1/30 | 181/152 |
| 8,406,444 | B2 * | 3/2013 | Wang | H04R 1/345 | 381/333 |
| 2015/0078605 | A1 * | 3/2015 | Yang | H04R 1/2888 | 381/353 |

* cited by examiner

OMNI-DIRECTIONAL PORTED SPEAKER

CROSS REFERENCE TO RELATED APPLICATION

This application is related to and claims the benefit of Chinese Patent Application Number 201510284222.5 filed on 28 May 2015, the contents of which are herein incorporated by reference in their entirety.

FIELD OF THE INVENTION

The present invention relates to speaker structure and more particularly, to an omni-directional ported speaker, which has multiple ducts for air flow.

BACKGROUND OF THE INVENTION

A conventional driver of a speaker is operated by causing a voice coil of the speaker to vibrate, and move a cone of the speaker to reproduce sound pressure waves to allow a user to hear the sound. In order to achieve a better effect, the driver is mounted in a cabinet for preventing acoustic short circuit by separating a front and rear sound field of the driver.

During the vibration of the voice coil, if the voice coil moves forward, the density of the air in front of the driver is increased, and air density behind the driver is reduced. If there is no block therebetween, the air with greater density moves toward the air with less density, and this is called acoustic short circuit. Acoustic short circuit relates to the frequency, in particular appears in low frequencies. Therefore, a well-designed cabinet can improve the effect of low frequencies.

Referring to FIG. 1, there are two kinds of speaker boxes differentiated by the structures therein. One is enclosure speaker, and the other is ported speaker. The ported speaker can produce much lower frequencies than the enclosure speaker. Typical ported speaker has an opening 4 and a duct 6 for connecting the driver 2.

When a ported speaker operates, the air flows in the duct quickly. However, the opening of the ported speaker is usually of insufficient size, which causes frictional loss during operation and results in noise of the ported speaker.

Inasmuch as aforementioned, an omni-directional ported speaker is herein disclosed in the present invention to resolve the drawbacks of the prior art.

BRIEF SUMMARY OF THE INVENTION

The invention provides an omni-directional ported speaker which can disperse the air in a single duct to eliminate the noise caused by the air friction in the duct.

The invention further provides a column-like structure, e.g. a pillar. Therefore, it is easy to connect to a driver of a speaker.

The invention additionally provides an adequate space of the column-like structure. The space is not only for a driver, but also for ducts. The length of the ducts can be elongated, and better low frequency response can be achieved.

More particularly, the invention provides an omni-directional ported speaker having a driver. The driver has a cone diaphragm portion and a driving portion. The omni-directional ported speaker comprises a cabinet for the driver mounted therein, and the cabinet has a first opening at one end portion and a second opening at the other end portion. The cone diaphragm portion of the driver is close to the second opening. A cover member is connected to the first opening, and the cover member has a first duct and a plurality of second ducts. The first duct and each of the second ducts have two openings. One of the two openings of the first duct is coupled to one of the openings of the second ducts, and the other opening of the first duct is disposed closing to the driving portion along the direction from the first opening of the cabinet toward the second opening of the cabinet. The other openings of the second ducts are arranged in the cover member, wherein the first duct and the second ducts included a first angle, and each of the second ducts included a second angle.

DETAILED DESCRIPTION OF THE PREFERRED EMBODIMENTS

In order to fully comprehend the objectives, features and efficacy of the present invention, a detailed description is described by the following substantial embodiments in conjunction with the accompanying drawings. The description is as below.

Figure 1:
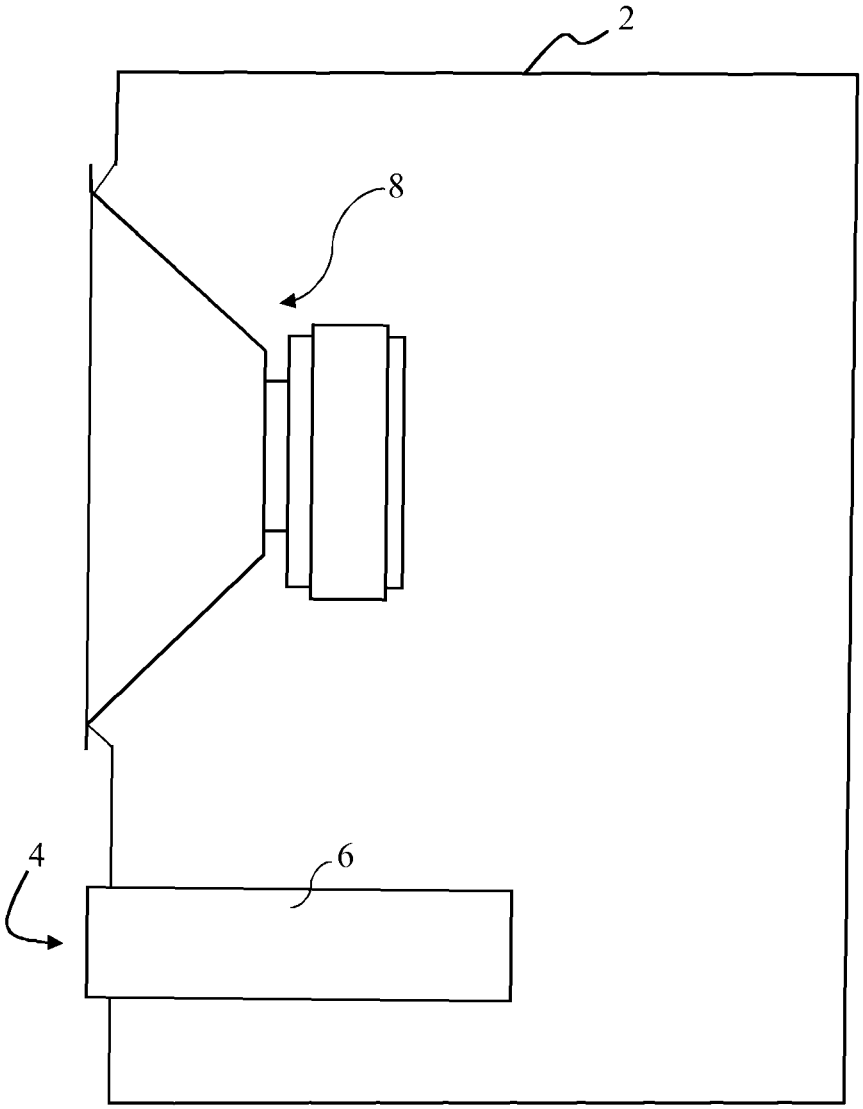
Fig. 1 (Prior Art)
FIG. 1 is a vertical cross-section of a prior ported speaker.
Figure 2:
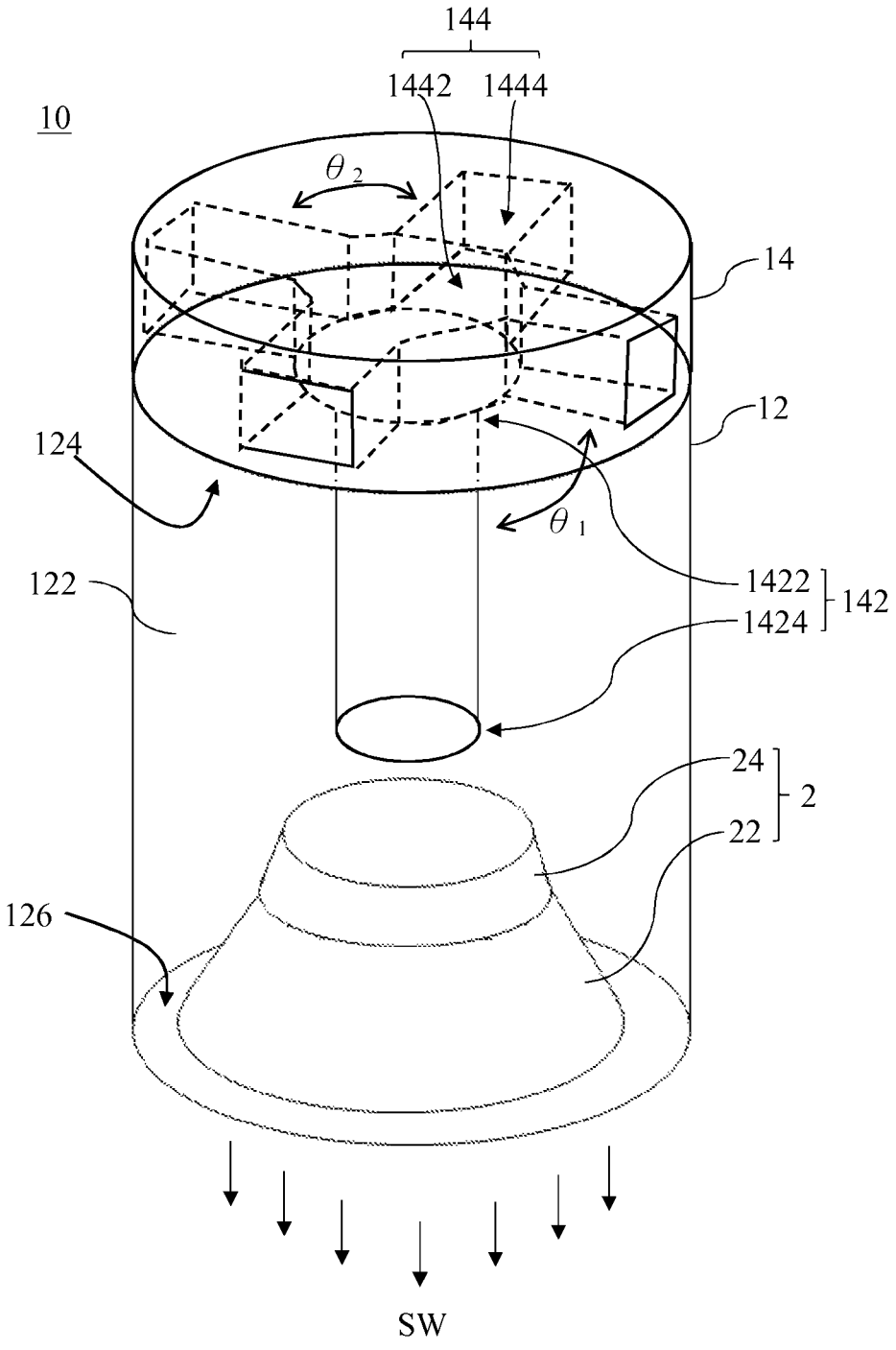
FIG. 2 is a perspective view of an omni-directional ported speaker in accordance with a first embodiment of the invention.

Referring to FIG. 2, it is a perspective view of an omni-directional ported speaker in accordance with the first embodiment of the invention. The omni-directional ported speaker 10 has a driver 2. The driver 2 comprises a cone diaphragm portion 22 and a driving portion 24. The driving portion 24 is acted by electric power to move the cone diaphragm portion 22 for produce sound wave.

The omni-directional ported speaker 10 comprises a cabinet 12 and a first cover member 14.

In the first embodiment, the cabinet 12 is a pillar. That is, the cabinet 12 is substantially cylindrical in shape. In other possible embodiments, the cabinet 12 can be other shapes. The inner side of the cabinet 12 is a space 122 for disposed the driver 2. The cabinet 12 has a first opening 124 at one end and a second opening 126 at the other end. As the driver 2 disposed in the space 122 of the cabinet 12, the cone diaphragm portion 22 is disposed at and serves to close the second opening 126. In particular, the driver 2 can be easily connected to the cabinet 12 because the shape of the driver 2 is circular shape in this embodiment which fits to the shape of the cabinet 12.

The first cover member 14 is connected to the first opening 124. Furthermore, the first cover member 14 and the first opening 124 can be connected in any sufficient manner such as, for example, by locking or clamping. The first cover member 14 has a first duct 142 and a plurality of second ducts 144. In the embodiment, the numbers of the second ducts 144 are four. In other embodiments, the number of the second ducts might be even or odd numbers.

The first duct 142 is disposed in the center of the first cover member 14, and has two openings 1422, 1424. Besides, each of the second ducts 144 also has two openings 1442, 1444. Furthermore, the second ducts 144 can have a shape of a rectangular tube, a pipe, or a square tube. The opening 1422 of the first duct 142 is coupled to the openings 1442 of the second ducts 144. The opening 1424 of the first duct 142 is disposed proximate to the driving portion 24 and the first duct 142 is arranged along the direction from the first opening 124 of the cabinet 12 toward the second opening 126 of the cabinet 12. That is, in this exemplary embodiment, the first duct extends axially within the pillar shaped cabinet 12. Each of the openings 1444 of the second duct 144 are arranged on the periphery of the first cover 14 and open outward of the cabinet 12. Besides, the side portion of the first duct 142 and the sides of the second ducts 144 delimit a first angle $\theta_1$, and each of the second ducts 144 delimit a second angle $\theta_2$ with respect to an adjacent second duct. The second angle $\theta_2$ is in accordance with a formula of 360°/A, and A is the numbers of the second ducts 144. In the first embodiment, the first angle $\theta_1$ is ninety degrees. Because the numbers of the second ducts 144 are four in the embodiment, the second angle $\theta_2$ is also ninety degrees.

Figure 3:
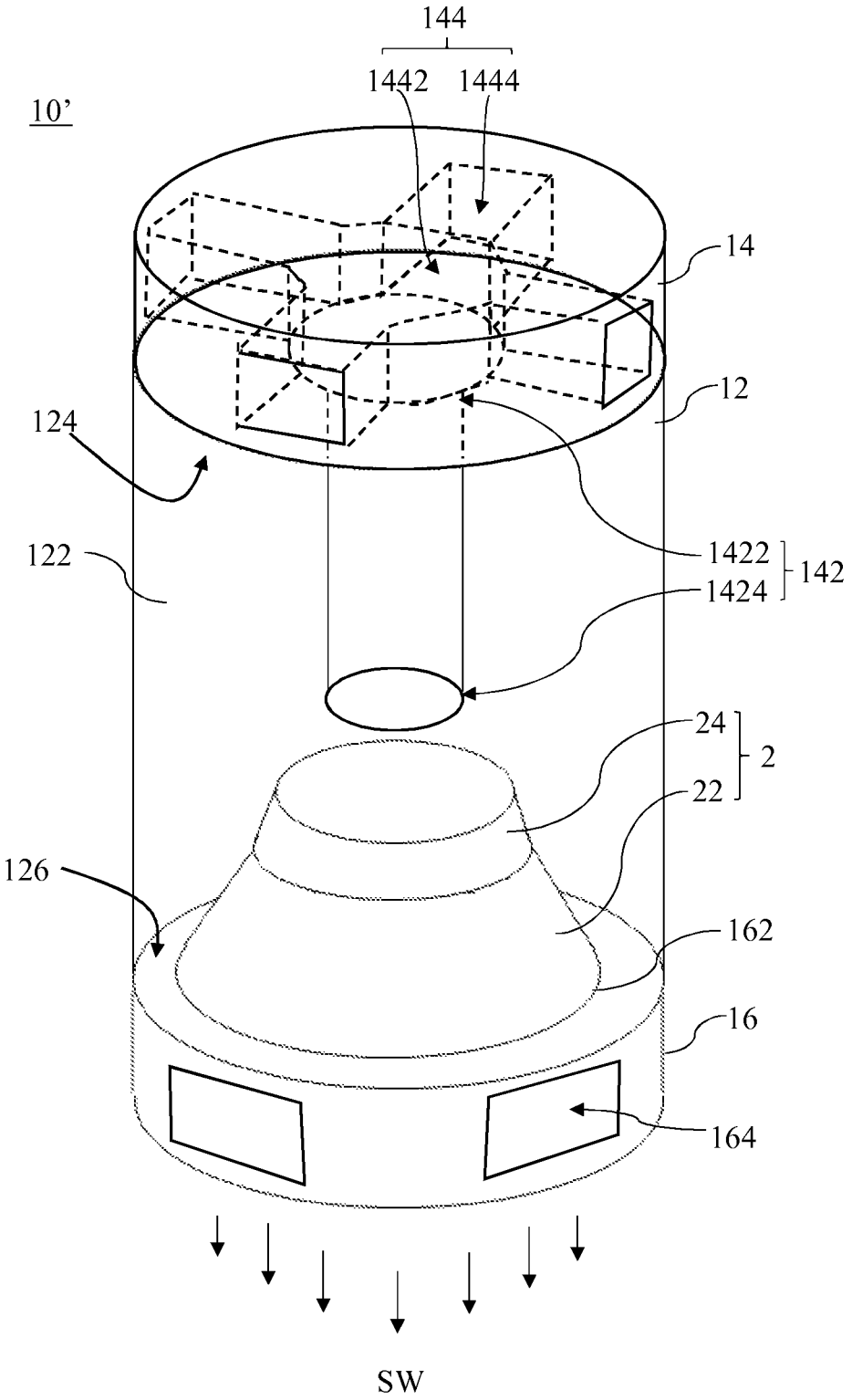
FIG. 3 is a perspective view of an omni-directional ported speaker in accordance with a second embodiment of the invention.

As shown in FIG. 3 which is the perspective view of an omni-directional ported speaker in accordance with a second embodiment of the invention, the omni-directional ported speaker 10' also has a cabinet 12 and first cover member 14 same as the first embodiment, however, the omni-directional ported speaker 10' further comprises a second cover member 16.

The second cover member 16 is connected to the second opening 126. Here, the driver 2 has a third opening 162 for the cone diaphragm portion 22 of the driver 2 to produce sound waves. Besides, there are several holes 164 disposed on the periphery of the second cover member 16. When the omni-directional ported speaker 10' is vertically placed, the sound waves can go through the holes 164. In the second embodiment, there are four holes 164.

Moreover, the first duct 142 and the second ducts 144 can be integrally formed such that they define a single continuous structure.

The present invention is disclosed by the preferred embodiment in the aforementioned description; however, it is contemplated for one skilled at the art that the embodiments are applied only for an illustration of the present invention rather than are interpreted as a limitation for the scope of the present invention. It should be noted that the various substantial alternation or replacement equivalent to these embodiments shall be considered as being covered within the scope of the present invention. Therefore, the protection scope of the present invention shall be defined by the claims.

What is claimed is:

1. An omni-directional ported speaker having a driver, the driver comprising a cone diaphragm portion and a driving portion, the omni-directional ported speaker comprising:

a cabinet with the driver mounted therein having a first opening at one end portion of the cabinet and a second opening at another end portion thereof, the cone diaphragm portion of the driver disposed within and closing the second opening;

a cover member connected to the first opening having a first duct and a plurality of second ducts, the first duct and each of the second ducts having two openings, one of the two openings of the first duct coupled to the first openings of the second ducts, and the other opening of the first duct disposed proximate to the driving portion of the driver, the first duct arranged along the direction from the first opening of the cabinet toward the second opening of the cabinet, wherein second openings of the second ducts are arranged in the cover member, wherein the first duct and the second ducts delimit a first angle, and each second duct delimits a second angle with respect to an adjacent second duct; and a second cover connected to the second opening of the cabinet, the second cover having a third opening;

wherein the first duct is tubular in shape, having opposing sides extending parallel between its two openings.

2. The omni-directional ported speaker as claimed in claim 1, wherein a plurality of holes are disposed in the second cover.

3. The omni-directional ported speaker as claimed in claim 1, wherein the number of the second ducts is an even or an odd number.

4. The omni-directional ported speaker as claimed in claim 3, wherein the second ducts include a shape that is substantially rectangular tube, pipe, or square tube.

5. The omni-directional ported speaker as claimed in claim 1, wherein the first angle is 90 degrees.

6. The omni-directional ported speaker as claimed in claim 1, wherein the first duct is disposed in a center of the first cover.

7. The omni-directional ported speaker as claimed in claim 1, wherein the second angle is in accordance with a formula of 360°/A, and A is the number of the second ducts.

8. The omni-directional ported speaker as claimed in claim 1, wherein the second angle differs between various adjacent second ducts.

9. The omni-directional ported speaker as claimed in claim 1, wherein the first duct and the second ducts are integrally formed to define a continuous structure.

10. The omni-directional ported speaker as claimed in claim 1, wherein the tubular shape of the first duct comprises a continuous cross section.

11. The omni-directional ported speaker as claimed in claim 10, wherein the cross section comprises a rectangular, square, or curvilinear shape.

12. The omni-directional ported speaker as claimed in claim 6, wherein the plurality of second ducts extend radially from the first duct.

13. The omni-directional ported speaker as claimed in claim 12, wherein the second angle is ninety degrees.

14. The omni-directional ported speaker as claimed in claim 1, wherein the cabinet is a pillar comprising an elongated cylindrical shape, the first opening of the cabinet disposed at one end of the cylindrical shape, the second opening of the cabinet disposed at an opposite end of the cylindrical shape, the first duct comprising a cylindrical tube mounted at its one opening to the cover member, the first duct extending axially through the pillar cabinet, the other of the two openings of the first duct disposed freely and unattached, adjacent to the driver at the second end of the cabinet.

15. An omni-directional ported speaker having a driver, the driver comprising a cone diaphragm portion and a driving portion, the omni-directional ported speaker comprising:

a cabinet with the driver mounted therein having a first opening at one end portion of the cabinet and a second opening at another end portion thereof, the cone diaphragm portion of the driver disposed within and closing the second opening; and a cover member connected to the first opening having a first duct and a plurality of second ducts, the first duct and each of the second ducts having two openings, one of the two openings of the first duct coupled to the first openings of the second ducts, and the other opening of the first duct disposed proximate to the driving portion of the driver, the first duct arranged along the direction from the first opening of the cabinet toward the second opening of the cabinet, wherein second openings of the second ducts are arranged in the cover member, wherein the first duct and the second ducts delimit a first angle, and each second duct delimits a second angle with respect to an adjacent second duct;

wherein the first duct is tubular in shape, having opposing sides extending parallel between its two openings; and wherein the second angle differs between various adjacent second ducts.

* * * * *